United States Patent [19]

Malmgren et al.

[11] Patent Number: 5,020,936

[45] Date of Patent: Jun. 4, 1991

[54] ANIMAL RUNNING SURFACE

[75] Inventors: Robert C. Malmgren; Jan Cipra; Edward L. Umlauf, all of Fort Collins, Colo.

[73] Assignee: International Soil Systems, Inc., Fort Collins, Colo.

[21] Appl. No.: 387,496

[22] Filed: Jul. 28, 1989

[51] Int. Cl.[5] ..... E01C 5/18

[52] U.S. Cl. ..... 404/32; 404/31

[58] Field of Search ..... 404/27, 31, 32, 75, 404/76, 82; 106/900; 272/3, 4, 5; 252/88

[56] References Cited

U.S. PATENT DOCUMENTS

| | | | |
|---|---|---|---|
| 2,848,840 | 8/1958 | O'Brien et al. | 47/1 |
| 3,446,122 | 5/1969 | Raichle et al. | 94/7 |
| 3,575,780 | 4/1971 | Trieschman et al. | 161/123 |
| 3,713,253 | 1/1973 | Urban | 47/58 |
| 4,073,753 | 2/1978 | Hauge | 404/32 |
| 4,082,888 | 4/1978 | Portin | 428/327 |
| 4,166,340 | 9/1979 | Pluenneke | 47/58 |
| 4,369,054 | 1/1983 | Shinholster et al. | 71/25 |
| 4,420,513 | 12/1983 | Coke et al. | 404/27 |
| 4,501,420 | 2/1985 | Dury | 272/3 |
| 4,522,389 | 6/1985 | Malcolm | 272/4 |
| 4,549,897 | 10/1985 | Seng et al. | 71/3 |
| 4,557,475 | 12/1985 | Donovan | 272/3 |
| 4,563,207 | 1/1986 | McKenzie | 71/21 |
| 4,564,310 | 6/1986 | Thelen et al. | 404/31 |
| 4,571,116 | 2/1986 | Patil et al. | 404/76 |
| 4,790,691 | 12/1988 | Freed | 405/263 |
| 4,792,133 | 12/1988 | Hawkins et al. | 272/3 |
| 4,819,933 | 4/1989 | Armond | 272/3 |
| 4,822,026 | 4/1989 | Schobermayr et al. | 272/3 |
| 4,830,532 | 5/1989 | Macke et al. | 404/31 |
| 8,203,396 | 8/1965 | Carmichael | 119/15.5 |

FOREIGN PATENT DOCUMENTS

| | | |
|---|---|---|
| 1159668 | 1/1984 | Canada . |
| 920487 | 11/1954 | Fed. Rep. of Germany . |
| 0151763 | 11/1981 | Fed. Rep. of Germany . |
| 61-123693 | 6/1986 | Japan . |
| 63-105615 | 5/1988 | Japan . |

OTHER PUBLICATIONS

Environmental Science & Technology, Mar. 1973 "Scrap Tires Can Yield Marketable Products" CKL, pp. 188–190.

J. American Society of Horticultural Science, 1975, "Tire Fabric Waste as Mulch for Fruit Trees", Tesky & Wilson 100(2), pp. 153–157.

BioCycle, Nov./Dec. 1983, "Woodchip: Rubber Tire Blend Works in Windsor" Harding et al., pp. 44–46.

Calif. Waste Mgmt. Board, Jun. 1986, "Scrap Tire Recycling in Calif.-A Status and Background Report".

Journal, "The Prospects of Using Natural Rubber for Conditioning Tropical Soils", Soong, pp. 105–110.

Fibar, Inc, Sales Brochure.

(List continued on next page.)

OTHER PUBLICATIONS

SNA Research Conf., 24th Report 1979, "Evaluations of Comb. of Pinebark, Peat, Shale, EKOL Leaf Mold and Shredder".

"Rubber in Growing Media" Cobb et al., pp. 37–39.

Miss. State Dept. Agronomy Soils, Progress Report 10/1/70–12/31/70, "Effect of Admixtures of Ground Rubber . . . Plant Growth" Jensen et al.

"Soil Chemistry Research with Ground Rubber in Soils" Glenn.

"Research with Ground Rubber" Progress Report III Ward.

Report on "Chemical Properties of Rubber & Reaction with Soil" Glenn.

Miss. State Dept. Agronomy Soils, Progress Report, 6/1/71–10/31/71, Jensen et al.

Technical Proposal, vol. 1, Waste Tire Utilization Doe-Idaho Oper. PRDA-DEPR07-87ID 12695.

SBA Innovation Research USDA Project Summary Proposal Rev. 88-00159 Fly et al.

*Primary Examiner*—Ramon S. Britts
*Assistant Examiner*—Gay Ann Spahn
*Attorney, Agent, or Firm*—Dean P. Edmundson

[57] ABSTRACT

An animal running surface composition and optimization technique is described. The surface provides a firm in-place foundation layer above which is spread a surface layer. The surface layer intermixes earthen material and rubber particles which may be sized from one-quarter to three-quarters of an inch. These particles may also be shredded rubber from scrap tires to assist in waste disposal. The ratio of the amount of rubber particles to earthen material in the surface, the size of the rubber particles, and the depth of the surface layer can be varied to optimize the surface for particular uses ranging from horse or equestrian tracks to dog tracks to arenas, etc. Several other variations such as the avoidance of organic material, removal of any metallic materials, and inclusion of other layers are also provided for. The present invention provides resiliency, optimizes water use, is porous for drainage, and can be reasonably constructed, among other advantages.

26 Claims, 1 Drawing Sheet

ANIMAL RUNNING SURFACE

1. BACKGROUND OF THE INVENTION

Figure 1:
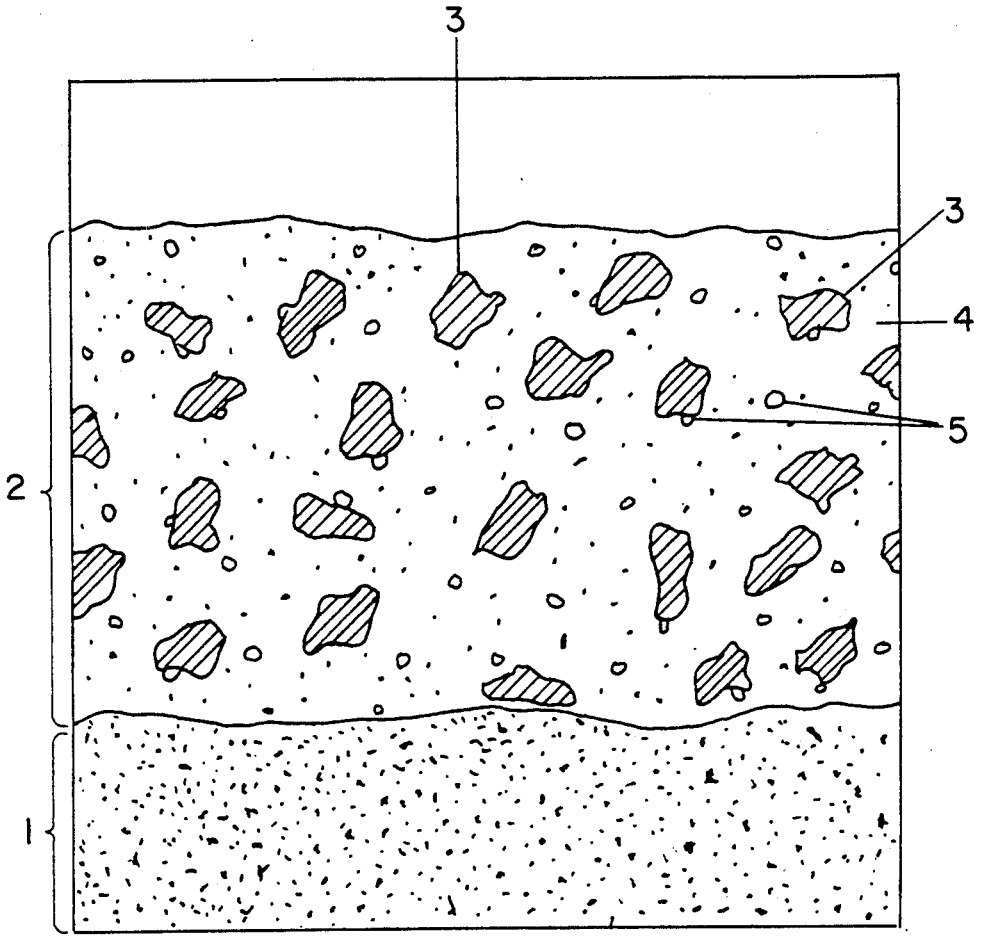

This invention relates to the field of animal running surfaces such as equestrian tracks, arenas, hot walkers, dog tracks, and the like. More specifically it focuses on a technique of optimizing the running surface with respect to several different characteristics. As an ancillary benefit to achieving its objectives, the invention--through its utilization of a common waste product--assists in the disposal of a particular waste product. Certainly most spectators of animal racing events assume that the tracks are simply soil. Until recently this was almost universally true. In creating such surfaces, minimal preparation was utilized. Vegetation was removed and the surface was periodically disked or graded to provide an even, smooth surface throughout the entire track. As the popularity of such racing events as horse racing or dog racing has increased, so has the focus on optimizing the event from many perspectives. Certainly the value of the animals has drastically increased. So too has the focus not only on optimizing their running potentials but also on minimizing any injury or stress forces that the animals experience.

Recently those skilled in the art of designing and maintaining animal running areas have realized that improvement of the surface itself was possible. Attempts have been made to mix a variety of items into the dirt at existing racetracks and arenas. Due to the nature of those involved in the sport, usually these efforts have involved farm by-products. These efforts have met with varying degrees of success. In some instances improvement may have occurred initially followed by a reduction in the quality of the running surface as the material decayed. In some instances the need to completely replace the surface as it has "worn out" may have occurred. As these types of limitations have become known, those skilled in the art of maintaining and constructing such surfaces have sought improved materials. Prior to the present invention, however, two approaches seemed available. Available material could be mixed into the dirt or the entire surface could be replaced by a synthetic surface. In mixing available material into the dirt a common item to use was wood chips. Not only can these increase the organic matter content, but they also decay relatively quickly. Unfortunately, these prior efforts had basically been the result of an unscientific "try-it-and-see" perspective. The long-term affects of these efforts are now being seen. Rather than merely considering the ease with which the surface is maintained, numerous other factors have come to the forefront. These factors differ in that they focus not on the maintenance crews' desires, but also on optimization of the surface for the animals themselves. The avoidance of injury and minimization of dust--although separately known to those skilled in the art--now are part of an integrated approach to surface construction and maintenance.

The present invention provides a new and improved technique for optimizing such surfaces. In doing so it not only greatly lengthens the time over which such surfaces remain effective, but it also provides a cost efficient surface. It departs from the approach of those utilizing wood chips in that a material which rapidly decays is specifically avoided. A particularly surprising aspect of the present invention is the fact that the material which provides this superior surface happens to also be available from a waste product--scrap tires. While efforts by those skilled in the art of constructing and maintaining animal running surfaces may have occasionally considered more highly processed materials, the present invention allows instead the utilization of a material whose disposal has been an unusual difficulty. This achieves two benefits at once.

Although efforts have been made to minimize the problem of waste tire disposal from a broad variety of vehicles, to date none of these efforts has met with great success. Certainly the rubber industry had attempted to develop uses for the waste product. As an example, the article "Scrap Tires Can Yield Marketable Products" published in 1973, explained efforts by a group called the Rubber Reclaimers Association (an industry consortium) proposed several different uses for the tires including mixing them into asphalt roads and providing crumbs as a foundation base below a house. Neither of these proposals has apparently met with great success. In 1986 a report entitled "Scrap Tire Recycling in California: A Status and Background Report" authored by the California Waste Management Board explained that of all the proposed disposal techniques, direct combustion was the most promising for eliminating the large numbers of scrap tires existing across the nation. Efforts by those focusing upon the disposal problem of scrap tires had even attempted to utilize shredded rubber for stabilization and growth enhancement of soils as detailed in "Evaluation of Combinations of Pine Bark, Peat, Shale, EKOL Leaf Mold, and Shredded Rubber in Growing Media". This article sharply contradicts the present invention in that it concluded that shredded rubber was not effective under certain soil chemical parameters for the desired result and thus rubber/soil mixtures should be avoided. The fact that those focusing on disposal of scrap tires never considered this application discovered by the present inventors underscores how separate and distinct the two fields are.

It should be understood that the present invention focuses upon the use of vulcanized rubber, not foam rubber and not natural rubber. Vulcanized rubber, although containing small amounts of natural rubber, is primarily a solid, non-porous, synthetic product. It differs markedly from foam rubbers and from natural latex rubber in these characteristics. Although efforts have been made to utilize these two products in soil combinations in other technical fields, their properties make them unsuitable with respect to the present invention. Similarly, efforts by those to utilize vulcanized rubber for other purposes have not led those involved in running surface construction and maintenance to consider this different application. As an example, U.S. Pat. No. 4,369,054 for a "Fiber/Slag Composition" focused upon the possibility of utilizing ground rubber in a broad variety of instances. None of these related to the peculiar needs of an animal running surface nor even generally to resiliency aspects.

Other efforts have focused upon playing surfaces. U.S. Pat. No. 4,564,310 for a "Resilient Paving Composition for Play Fields, Sports Fields and Recreation Areas" discloses the approach of providing an entirely synthetic surface. Although this patent did suggest using finely ground vulcanized rubber such as from scrap tires, the material was used in a manufactured surface. This surface was bonded with latex to provide the paving composition desired. It was not a loose soil surface as in the present invention. Similarly, U.S. Pat.

No. 3,446,122 for "Elastic Surfaces for Sportsgrounds, Playgrounds and Footpaths" discloses an entirely manufactured surface which is separate from the dirt layer involved. The material used, polystyrene, is unlike the solid, vulcanized rubber used in the present invention and is not intermixed with earthen material. This is also true of U.S. Pat. No. 4,501,420 for "Playing Surfaces Sports". Although it used vulcanized rubbers such as from scrap tires, it provided a bonded, polymeric material which was not intermixed with earthen material and even had a synthetic turf overlayed upon it. Again, none of these patents disclosed a product which was appropriate for an animal running surface as contrasted to human playing surfaces.

Efforts have been made to improve animal running surfaces using a variety of techniques. In U.S. Pat. No. 3,203,396 for a "Method of and Means for Modifying Race Courses" the need for a resilient surface for a horse track was recognized. Rather than providing a technique for modifying a surface, that disclosure provided a means for separating the track to allow work on the compacted and worn out areas while the other area was used. Finally, in U.S. Pat. No. 4,819,933 for "All Weather Surfaces" the desire to provide a suitable equestrian surface using an intermixture of materials was disclosed. That recent invention focused upon a mixture of sand and synthetic fibers. The synthetic fibers were used in very small percentages (less than 1%) primarily to act as a binder to avoid any loose movement of the surface when in use rather than for resiliency. The present invention differs markedly in that binding of the surface layers is specifically avoided so that a loose surface as has historically been used is still possible.

The fact that there have been numerous efforts by those involved in the art of disposal of waste tires and the art of improving playing surfaces simply highlights the uniqueness of this application and the distinctness of the art of constructing and maintaining an animal running surface. In this field, efforts to mix a variety of by-products into a running surface had been done for years. These attempts, however, were inadequate because they failed to recognize the problem due to their failure to focus first upon the animals' needs rather than those of the maintenance crew. While recently those skilled in the art have begun to appreciate the need for an improved surface, they have not had available to them knowledge from unrelated fields such as that of tire disposal. Instead, their focus was directed primarily to what was at hand since it was understood by many that an acceptable solution could not utilize an "exotic" material while remaining cost effective. Until the present invention, those skilled in the art of racetrack construction, renovation, and maintenance simply did not have available to them a suitable product from the varied perspectives involved.

Apart from the particular material utilized, the present invention also presents methods which allow for the optimization of the surface to particular conditions. Given the limited focus of those involved in the construction and maintenance of animal running surfaces, this approach is a unique departure from the efforts of those skilled in the art. Prior to the present invention it had generally been assumed that one particular composition which was generally acceptable to a broad variety of conditions should be utilized. While the present invention provides for such a broad scale approach, it also presents methods which allow for optimization of the surface to accommodate the particular conditions encountered. In this fashion the present invention presents an approach heretofore unheard of by those skilled in the art of construction and maintenance of animal running surfaces.

2. SUMMARY OF THE INVENTION

It is an object of the present invention to optimize an animal running surface. In so doing an object is to provide a surface which is cost effective and longer lasting. The present invention is also designed to minimize any need to replace the surface after it has been used.

Broadly stated, an object of the present invention is to provide a means to minimize or avoid any injury or excessive ground force reactions that an animal experiences when running, jumping, or otherwise, moving over a surface.

As part of minimizing the potential injury an animal experiences, it is an object of the present invention to provide a surface which cushions the impact experienced by the animal in running upon that surface. It is also an object to provide a surface which minimizes dust and ill effects upon the respiratory system of the animals running upon the surface.

The surface is also optimized through achieving the object of providing a surface which does not become compacted over time and consistently allows water percolation through pores maintained within the surface. It is also an object of the present invention to optimize the surface by allowing for easy variation in its specific parameters to suit the particular climatic, geographic or use requirements.

It is a further object of the present invention to provide a method for disposal of scrap tires which is not only environmentally suitable but actually provides a desirable result. In keeping with the cost-efficient desire, it is an object of the present invention to minimize the amount of outside material utilized in the surface and to minimize the amount of effort necessary to create the optimum surface. It is also an object of the present invention to utilize a material which is readily available by local supply rather than a material which requires shipping in bulk quantities.

Naturally further objects of the invention are disclosed throughout other areas of the specification and claims.

3. BRIEF DESCRIPTION OF DRAWING

FIG. 1 is an enlarged cross sectional representation of an animal running surface as described herein.

4. DETAILED DESCRIPTION OF THE PREFERRED EMBODIMENTS

As can be seen from the drawing, the basic concept of the present invention is easily understood. It involves creating a surface having at least two layers. Foundation layer (1) is a base formed in most instances of primarily indigenous, firm in-place soil. By utilizing indigenous soil the cost of creating foundation layer (1) is greatly minimized. While in rare instances additives or even replacement might be desirable to overcome peculiar soil characteristics, since foundation layer (1) is covered by surface layer (2), such occurrences should not be common. In utilizing firm in-place soil, it is intended that foundation layer (1) might comprise anything other than loose soil. The foundation layer (1) may be achieved in any number of ways including man made consolidation effects. Since the degree of consolidation necessary to achieve a firm in-place soil is not extreme, it is anticipated that the vast majority of users will allow for consolidation to occur naturally either by prior use of the surface (due to the weight of the animals), by consolidation occurring during construction (due to the weight of people and equipment traveling over the surface), or even by consolidation due to gravity when vegetation is not present to continuously uncompact foundation layer (1). These are merely some of the possibilities through which conditions equivalent to the broadly stated firm in-place requirement can be met. Certainly other possibilities exist.

At some layer above foundation layer (1) there exists surface layer (2). While in most cases surface layer (2) will be the only layer above foundation layer (1), it is entirely possible that other layers could be utilized for particular surfaces. Surface layer (2) comprises an intermixture of rubber particles (3) and earthen material (4). Rubber particles (3) may be predominately made of vulcanized rubber as would be found in scrap tire material. This rubber is not an open pore, foam rubber, rather, it is a solid rubber made of primarily synthetic materials. Although some natural rubber is utilized in creating vulcanized rubber, this percentage is relatively minor. Additionally, it should be noted that natural rubber in a liquid state such as latex does not possess the necessary properties to achieve the ends required by the present invention. Natural latex, occurring in the liquid form is not sufficiently solid to provide the resilience required.

Earthen material (4) is intermixed with rubber particles (3) and can be a broad variety of materials. While in the vast majority of cases indigenous soil will be utilized, in some instances where the indigenous soil is inappropriate for one reason or another, other earthen material might be utilized. It should be understood that although many indigenous soils may appear as firm in-place, that does not necessarily make them unsuitable for use in surface layer (2) of the present invention. Firm in-place soils frequently tend to become uncompacted simply by manipulating them in the process of creating surface layer (2). Once uncompacted, surface layer (2) would resist compaction by operation of rubber particles (3). This resistance to compaction is a key to the present invention.

In considering the type of earthen material utilized in surface layer (2) it should be understood that generally clay-type soils are undesirable. Such soils tend to compact easily and do not provide a sufficient amount of percolation and pore spaces to achieve the desired result. By a clay soil it is meant that any soil comprising more than about 40% clay-sized particles would be included. When such materials are indigenous, the material should either be diluted such as by intermixing it with washed sand, or should be replaced by another readily available material. In diluting a clay soil with washed sand, it should be understood that rubber particles (3) are critical to achieving the desired result. Without the intermixture of rubber particles (3), the simple sand/clay mixture tends to consolidate even further, rather than create the open surface desired.

Earthen material (4) might also be chosen to minimize the amount of organic material included. As mentioned earlier, organic material was frequently utilized as it is a natural byproduct of farm operations and is readily available and difficult to dispose of. While these criteria are helpful, the fact that organic material decays makes it undesirable for several reasons. First, upon decay the material tends to create fine particles or dust. As mentioned dust may pose health problems. Second, by the mere fact that organic material decays, it means that the surface will be in a constant state of change and deterioration. Eventually, it may even require replacement such as is the case when wood chips are used. Although the rubber utilized in the present invention also decays, its decay is much slower; thus while achieving the object of being ecologically sound due to some rate of decay, it also provides a relatively long lasting surface.

A unique element of the present invention is that rubber particles (3) can be comprised of pieces from scrap tires. The only conditioning that is desirable is the removal of any metal (such as in steel belted tires) from the rubber prior to its utilization. This task is easily achieved as shredded pieces of scrap tires with the metal removed are readily available on a commercial basis. Certainly if other elements or reactants were discovered to be contained within rubber tires in the future, such materials might also need to be removed prior to its utilization for purposes of the present invention. Since rubber particles (3) should contain only minimal amounts of or no metallic material, the upper limit of size for rubber particles (3) has been restricted to the largest size readily available from commercial disposal sources. As the size available from these sources increases, so might it be discovered that larger sizes also would be desirable under the techniques of the present invention.

A variety of ranges is possible for the size of rubber particles (3). Unlike efforts in unrelated fields that have attempted to utilize powdered rubber (20 mesh and smaller), the present invention utilizes sizable pieces. At a minimum, rubber particles (3) should be at least one-quarter of an inch in diameter. In assessing the optimum size, it has been discovered that particles less than one-quarter of an inch in size (i.e. the longest dimension) tend to diminish the optimum resilience desired from surface layer (2). On the larger end, it has been found that rubber particles (3) predominately sized greater than three-quarters of an inch tend to provide too loose a surface for optimum running conditions. Presently it is believed that particles predominately five-sixteenths of an inch in size pose the optimum size for a variety of running conditions. Certainly smaller particles may be appropriate for lighter animals. The five-sixteenths size is believed to be the optimum for horse running tracks. In considering the optimum size for non-custom applications (applications where the particular type of use is not thoroughly analyzed), the five-sixteenths inch sized particles are applicable to a wide range of conditions.

A significant other variable is the consideration of the ratio of the volume of rubber particles (3) to earthen material (4) in creating surface layer (2). Certainly the percentage varies greatly dependent upon use. For heavier animals such as a horse, the percentage should be higher. In addition, the percentage is affected by: (i) the amount of clay intermixed in earthen material (4) (the higher the amount of clay, the higher the amount of rubber necessary); (ii) the amount of organic material intermixed with earthen material (4) (the higher the amount of earthen material, the higher the ratio of rubber necessary); and (iii) the hardness desired by surface layer (2) (the harder the surface the lower the ratio of rubber desired). Within a broad range of applications the percentage of the volume of rubber particles (3) to the total volume of surface layer (2) ranges from about 15% to 40%. For a broad variety of applications a generalization may be made that this percentage should be about 20%. Again, this does not result in an acutely optimum condition but rather presents a condition which is much better than current conditions and is applicable on a broad scale.

In creating surface layer (2) the depth of the layer might also be varied. This allows for enhanced conditions (such as in a turn on a racetrack) without the necessity of creating different batches with different ratios or sizes of particles. Simply put, this depth ranges from 1 to 8 inches with a general depth of 4 to 6 inches covering a broad spectrum of applications. Again, this technique not only allows for the ranges necessary to optimize a surface to a particular desired condition but also provides a range which would allow broad scale application with minimal investigation.

One of the fundamental perspectives that allows development of the present invention was the departure by the inventors from the perspective which usually focused on the ease of the maintenance crew rather than the optimization of a surface from the perspective of the animals. By focusing upon the needs of the animals, the present inventors have achieved a significant degree of improvement in running surfaces. Fortunately, an otherwise waste material could be utilized to allow competitive costing compared to other efforts. Chief among the needs to assist the animals was the need to minimize injury or damage to joints and tendons of the animals. Since racing animals can be quite valuable, unduly shortening their career through tendon or joint damage has been highly undesirable. Although prior to the present invention efforts were made to reduce the degree of injury and damage experienced, rarely was the track the focus. By providing a surface which is resilient, significant decreases in such wear or injury should be realized. The resiliency of the surface is provided by a synergistic effect between the natural resilience of rubber particles (3) and the creation and consistent maintenance of significant pore spaces within surface layer (2). Referring back to FIG. 1, it can be seen that macropores (5) tend to increase in the presence of rubber particles (3) and with surface layer (2). These pore spaces provide gaps within which compression can take place. Upon impact of an animal's foot or hoof on surface layer (2), both macropores (5) and rubber particles (3) can become compressed. As soon as the pressure is released, a return to a similar state occurs and the material can again function as desired. While rubber particles (3) return to their original state, macropores (5) can simply be recreated at some locations within earthen material (4). It should be understood that the simple use of rubber having a degree of resilience does not provide the desired footing for an animal running surface. Rather, the synergistic effect of the rubber particles (3) with macropores (5) as inherent when mixed with earthen material (4) creates this desired effect. Rubber particles (3) both provide resilience and act as a catalyst to enhance the openness of surface layer (2). They prevent compaction from becoming a problem.

An additional enhancement for the animals is the minimization of dust from surface layer (2). Dust can cause respiratory problems in animals who breath heavily over the surface. To avoid this problem, the present invention incorporates two aspects. First, dust producing materials such as silts, and organic matter are minimized in surface layer (2). These materials breakdown and/or dry out resulting in fine particles which are subject to becoming airborne. Second, the resiliency of the surface creates an increased depth of penetration of the water whether precipitation or artificially applied. During wet times, macropores (5) aid in the ability of surface layer (2) to remove excess water by percolation. During dry times, macropores (5) actually help moisten the surface by acting in conjunction with micropores (typically present in most soils) to draw moisture from below through capillary action. In this fashion the present invention also meets the needs of operators. By creating macropores (5) the surface layer (2) minimizes the need for constant watering. Presently dust is minimized by watering the running surface. Although this remains desirable with the present invention, during extremely dry periods the amount of water necessary to maintain an acceptable dust environment is significantly decreased.

Although the invention has been developed primarily to provide advantages to the animals utilizing the surface, a number of distinctive advantages exist from the perspective of the operator. Certainly a most important advantage is the fact that rubber particles (3) can be obtained relatively inexpensively. By utilizing shredded rubber from scrap tires, surface layer (2) is cost-effective. Although providing a superior surface, it can be constructed at cost levels consistent with the types of surfaces currently used by others skilled in this field. As mentioned earlier, the surface is also long lasting. Surface layer (2) maintains its resiliency and openness over a relatively long period of time. It does not, however, last so long as to become an ecological problem. It is estimated that rubber particles (3) decay in about 20 years. Through the removal of the metal and other such undesirable components as mentioned earlier, impact on the environment is also minimized.

Another benefit from the operator's perspective is the fact that surface layer (2) can be utilized over a broader temperature range and over broader weather conditions. Although current surfaces can be used even in hot climates, when the surface freezes, it becomes too hard and slick to be used. Not only does the inclusion of rubber particles (3) tend to delay the freezing of surface layer (2) by having higher heat capacity and heat absorbing qualities, but even when the soil is frozen, the rubber still maintains some degree of resiliency. Although this resiliency can become reduced in extremely cold environments, surface layer (2) does not become as hard as frozen ground allowing extended operating seasons to be achieved. Likewise, existing surfaces have limitations when either very dry or very moist climates are involved. Through use of the present invention, the animal running surface can be utilized over both drier and more moist climates. Again, this results in extended utilization of the running surface. In dry climates, generally dust is the key factor. Through the inclusion of macropores (5), dust is reduced as mentioned earlier. Rubber particles (3) tend to enhance water penetration and thus keep the surface at an appropriate moisture level for a longer period of time. They also reduce dust by minimizing the structural aggregation of the soil. In extremely moist climates, wet tracts can become a problem. In the present invention, water percolates much better and internal drainage is facilitated by the rubber. This again is the result of macropores (5) within surface layer (2). As a modification for wet situations, it is of course possible to include an intermediate layer between surface layer (2) and foundation layer (1) to aid in the percolation of water. In essence, the present invention tends to not only increase percolation and prevent ponding, but also tends to retain "moist" conditions for a somewhat longer period of time.

As those skilled in the art of animal running surfaces will understand, the foregoing advantages can apply in a variety of situations. Certain horse tracks and dog tracks come to mind as potential applications. Arenas and any other instance where animals apply impact forces to a surface are also, of course, possible. Jumping areas, cutting surfaces, and tracks are also areas in which the surface would be useful. It should be understood that such applications are not intended to act as a limitation, rather they are intended to only be representative of the type of applications to which the surface may apply. Again, only the basic criteria of providing a more appropriate surface would serve as a limitation.

A unique aspect of the present invention is the fact that the surfaces can be optimized for particular conditions. Optimization can be had by considering not only the climatic situation and the particular indigenous soil at the site, it can also be optimized by considering the particular use involved. This latter aspect can involve not only consideration of the weight of the animals utilizing the surface, but also the degree of vigor with which the surface is used by the animals. For instance in jumping applications it is anticipated that a larger degree of resiliency will be desired. In such a case both greater depth and larger ratios might be utilized to optimize the surface. Likewise, even within one surface different ratios or depths might be utilized. For instance, on a straightaway, the risk of tendon damage on a horse track might be less than that in the turn portions of a racetrack. For this reason different depths and/or different ratios might be utilized between the straightaway and the turn areas of the race track. As mentioned earlier, only generalities can be stated at this time as definitive testing has not occurred to determine the exact parameters.

In optimizing a particular surface, the present invention incorporates testing of the existing surface to be renovated. By analyzing the condition of the existing surface, broad scale effects can be understood regardless of their specific cause at that site. One of the most important parameters is the assessment of the "hardness", including its resiliency or shock absorbing capability, of the existing surface. The present invention can accomplish this through two different means. Either a soil penetrometer or an impact tester can be utilized. A penetrometer, although designed to understand root zones in planted surfaces, provides excellent information to assess the degree and depth of compaction in typical use. Recently, the use of an impact tester has been investigated. It is believed that this type of testing will simplify the determination necessary for optimum resiliency by focusing entirely upon the cushioning effect of the surface. The existing surface can also be tested for the organic matter fraction and to ascertain the percentage of clay present through standard techniques. Each of these allow optimization in renovating the surface. Climatic conditions can also be incorporated in determining the optimum renovation. Both drainage and annual rainfall allow decisions to be made to minimize the amount of rubber necessary. This also contributes to providing a cost effective surface. Again, the exact parameters have not yet been established and so details with respect to just how the results of surface analysis and climatic assessment impact the renovation process are not yet available.

The foregoing discussion and the claims which follow describe the preferred embodiment of the present invention. Particularly with respect to the claims, it should be understood that changes may be made to the invention without departing from its essence. In this regard it is intended that such changes would still fall within the scope of the present invention. It simply is not practical to describe and to claim all possible revisions to the present invention which may be accomplished. To the extent such revisions utilize the essence of the present invention, each would naturally fall within the breadth of protection encompassed by this patent.

We claim:

1. An animal running surface comprising:

a. a foundation layer comprised of indigenous, firm in-place soil; and b. a non-compacted surface layer extending for a specified depth which comprises a mixture of:

(1) non-foam, solid rubber particles having a size in the range of about 0.25 to 0.75 inch in diameter; and (2) earthen material;

wherein said rubber particles comprise about 15 to 40% by volume of said surface layer.

2. An animal running surface as described in claim 1 wherein said non-foam, solid rubber particles comprise pieces of scrap tire rubber.

3. An animal running surface as described in claim 2 wherein said pieces of scrap tire rubber contain no more than insignificant amounts of metallic material.

4. An animal running surface as described in claim 3 wherein said pieces of scrap tire rubber comprise fragments predominately five-sixteenths of an inch in size.

5. An animal running surface as described in claims 1, 3, or 4 wherein the percentage of the rubber particles to the volume of said surface layer is 25% to 30%.

6. An animal running surface as described in claims 1, 3, or 4 wherein the depth of said surface as described in claims 1, 3, or 4 wherein the depth of said surface layer ranges from one to eight inches.

7. An animal running surface as described in claims 1, 3, or 4 wherein the depth of said surface layer ranges from four to six inches.

8. An animal running surface as described in claims 1, 3 or 4 wherein the depth of said surface layer is six inches and wherein the volume percentage of the rubber particles to the volume of said surface layer ranges from 15% to 25%.

9. An animal running surface as described in claim 1 wherein said earthen material comprises uncompacted indigenous soil.

10. An animal running surface as described in claim 1 wherein said earthen material comprises uncompacted, non-clay soil.

11. An animal running surface as described in claim 10 wherein said earthen material contains insignificant amounts of organic material.

12. An animal running surface as described in claim 8 wherein said earthen material comprises uncompacted, non-clay soil and contains insignificant amounts of organic material.

13. An animal running surface as described in claims 1, 3, 5, wherein said surface mixture further comprises an oil.

14. An animal running surface as described in claim 13 wherein said surface layer mixture further comprises a dust retardant oil.

15. A method of preparing an animal running surface comprising the steps of:

a. evaluating the existing surface on which said animal running surface is to be prepared; and then b. preparing a foundation layer;

c. determining an appropriate level of resiliency for said running surface; and then d. creating the appropriate level of resiliency by intermixing both non-foam, solid rubber particles having a predominant size and uncompacted earthen material; wherein said rubber particles have a size in the range of about 0.25 and 0.75 inch in diameter and wherein said rubber particles comprise about 15 to 40% by volume of said surface layer;

e. spreading said intermixture upon the foundation layer.

16. A method of preparing an animal running surface as described in claim 15 wherein said step of evaluating comprises measuring the hardness of the existing surface; and wherein said hardness is utilized to ascertain the proper percentage of said rubber particles to be intermixed with said earthen material.

17. A method of preparing an animal running surface as described in claim 16 wherein said step of measuring the hardness is accomplished by means of a penetrometer.

18. A method of preparing an animal running surface as described in claim 16 wherein said step of measuring. the hardness is accomplished by means of an impact tester.

19. A method of preparing an animal running surface as described in claim 15 wherein said rubber particles have a size of about five-sixteenths of an inch in diameter and wherein said intermixture has a depth in the range of about 1 to 8 inches.

20. A method of preparing an animal running surface as described in claim 16 wherein said step of evaluating further comprises the step of sampling the existing surface.

21. A method of preparing an animal running surface as described in claim 20 wherein said step of evaluating further comprises the step of testing said existing surface to ascertain the organic matter fraction of said existing surface.

22. A method of preparing an animal running surface as described in claim 20 wherein said step of evaluating further comprises the step of testing the portion of the existing surface that is a clay material.

23. A method of preparing an animal running surface as described in claim 15 and further comprising the step of ascertaining the climatic conditions encountered by the existing surface.

24. A method of preparing an animal running surface as described in claim 23 and further comprising the step of assessing the drainage present for the existing surface.

25. A method of preparing an animal running surface as described in claim 24 wherein said step of ascertaining the climatic conditions comprises the step of determining the amount of moisture deposited upon the existing surface annually.

26. A method of preparing an animal running surface as described in claims 15 or 16 wherein said step of determining an appropriate level of resiliency minimizes the amount of rubber utilized.

* * * * *